United States Patent [19]

Luithle

[11] 4,095,868

[45] Jun. 20, 1978

[54] CONTACTING DEVICE FOR CONNECTING THE END OF AN ELECTRIC WIRE

[75] Inventor: Erik Luithle, Erlangen, Germany

[73] Assignee: Siemens Aktiengesellschaft, Berlin and Munich, Germany

[21] Appl. No.: 794,795

[22] Filed: May 9, 1977

[30] Foreign Application Priority Data

May 19, 1976 Germany ..... 2622323

[51] Int. Cl.[2] ..... H01R 9/08; H01R 13/62

[52] U.S. Cl. ..... 339/95 D; 339/205; 339/274

[58] Field of Search ..... 339/95 R, 95 D, 74 R, 339/274, 205

[56] References Cited

U.S. PATENT DOCUMENTS 2,720,634 10/1955 Hart ..... 339/95 D

FOREIGN PATENT DOCUMENTS 2,258,156 5/1974 Germany ..... 339/95 D

*Primary Examiner*—Neil Abrams

*Attorney, Agent, or Firm*—Kenyon & Kenyon, Reilly, Carr & Chapin

[57] ABSTRACT

A contacting device for building up wiring panels, to which up to three wire ends can be connected without using elaborate wiring tools, in which a leaf spring having two stable flexed positions is held in bent condition in the cavity of an insulator body. In one flexed position, the wire ends are pressed against a contact tab of a contact member disposed in the cavity by means of a front edge of the leaf spring which is forked at that one end.

15 Claims, 7 Drawing Figures

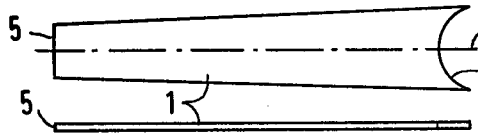
Fig. 1a
Fig. 1b
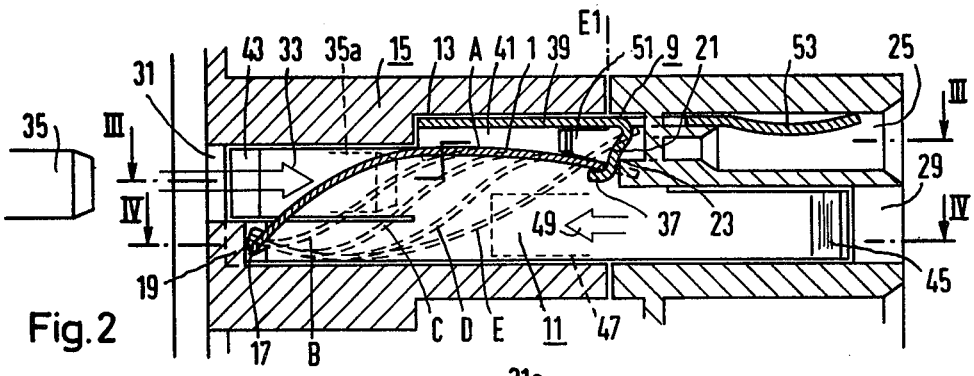
Fig. 2
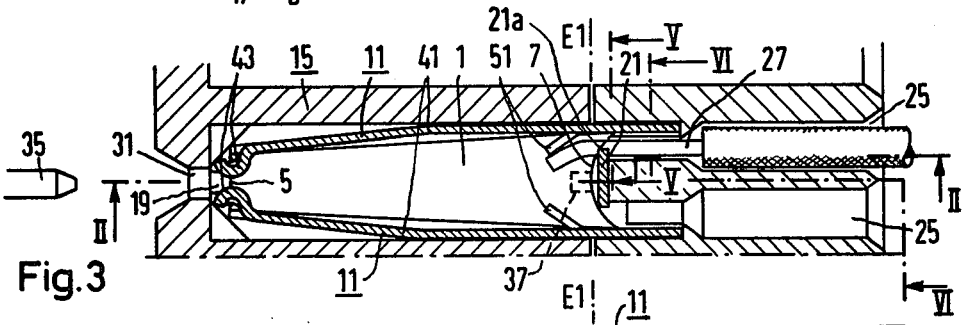
Fig. 3
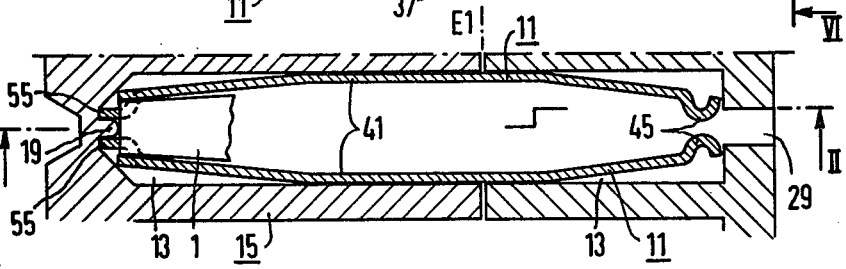
Fig. 4
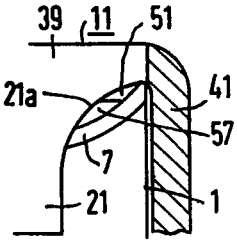
Fig. 5
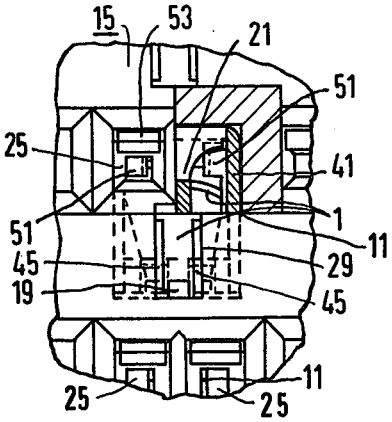
Fig. 6

CONTACTING DEVICE FOR CONNECTING THE END OF AN ELECTRIC WIRE

BACKGROUND OF THE INVENTION

This invention relates to contacting devices in general and more particularly to an improved contacting device for connecting the end of an electrical wire, in which an elastic element fastens the wire end mechanically to a contact element and ensures sufficient contact pressure between the wire and the end of contact element.

Contacting devices of this general nature are commercially available in the form of a clamped connection which is known as a Termi Point Connection. Such is described in the book "Industrieelektronik" (Industrial Electronics) by D. Ernst and D. Strole, Springer Verlay, Berlin Heidelberg/New York, 1973, page 101. In a clamped connection of this type, a clamp, in the form of an elastically deformed element, pushes a stripped wire end of a solid or stranded conductor against a contact element in the form of a contact pin. The clamp grips both wire end and the contact pin.

Such clamped connections are made utilizing a manually or pneumatically operated wiring tool. Because of the first forces which occur during clamping, a deformation of the wire end and the clamp occurs and thereby a reliable and gastight pressure connection is made. It is possible to place up to three such clamped connections on one contact pin, one behind the other. Clamped connections of this nature are used for wiring of terminal boards. Terminal boards of this nature are found for example on the rear of a modular chassis and are utilized for the functional interconnection of various modules, e.g., subassemblies, mounted on the front side of the chassis.

The disadvantages of this contact device are that a complicated and expensive wiring tool is necessary for connecting the wire ends, and it is not easy to make changes should errors in wiring occur. This problem with making changes is particularly severe where two or three connections are made on a contact pin one behind the other. In that case the outer connection which has been clamped must be bent up with a suitable tool to make available the inner clamp. Reestablishing the connection which has been changed again requires the use of a special wiring tool. Furthermore, with a contacting device of this nature, it is particularly important that the size of the cross section of the wire be carefully matched to the end dimension of the contact device.

Another type of connection is a wire-wrap connection. In making such connections solid conductors are wrapped several times around a pin shaped contact element using a complicated wrapping tool. In such a connection because of the sharp corners of the contacting element, the element itself and the solid conductor are notched and as a result any poorly conducting surface layers are pierced. In such a technique it is also possible to make several wrapped connections on a single contact element one behind the other. The disadvantages of this technique are, as with the clamped connections, that a complicated wrapping tool is needed and that it is not easy to make changes. Furthermore, wires with special insulation are required.

In view of these difficulties the need for an improved contacting device of the general type mentioned above on which several wires of different cross sections and different nature can be connected without the need for expensive, complicated wiring tools and which permits easily making changes is evident.

SUMMARY OF THE INVENTION

In accordance with the present invention this need is fulfilled by providing a contact arrangement in which a leaf spring serves as the elastic element. The leaf spring is disposed within the support in such a manner that its first end is in stationary abutment, and that its second end is movable between a relief position and a clamping position. The second end is arranged so that it rests against different points of the support surface depending on whether or not it is in the released or clamped position. The distance between the abutment and the support surface is smaller than the length of the leaf spring. When in the clamping position, the second end of the leaf spring pushes the end of the wire against a contact surface of the contact element. However, it again releases the wire when it is in the released position.

By making the distance between the point of abutment at one end of the leaf spring and the support surface at the other end such that it is shorter than the length of the spring, the leaf spring is always bent over. There are two stable positions for a leaf spring, in one position the leaf spring has convex curvature with respect to its lengthwise dimension and in the other it has concave curvature. It is these two stable positions of the leaf spring which are used in conjunction with the stationary support on one side in order to press the wire end against the contact element with the second movable end of the leaf spring and make a good connection thereby bringing about good ohmic contact, or, when the leaf spring is in the other stable position, to release wire. The setting of the leaf spring to desired position is accomplished from the outside by a mechanical action on the portions of the area of the leaf spring between the abutment and support surface. In order to connect the end of the wire, the latter need only be inserted while the leaf spring is in the release position and the leaf spring subsequently brought into its second stable position, the clamping position. This can be accomplished, for example by using a screw driver and without the use of any special tool. In similar fashion, in order to disconnect the connection, the leaf spring need only to be snapped into its original release position, again without the need for a special tool. The contacting device of the present invention is not critical with respect to different conductor cross sections and it is immaterial whether solid or stranded conductors are used. Thus, the contacting device of the present invention avoids the use of expensive and complicated wiring tools, has a variety of uses, and provides a high degree of changeability.

In accordance with the illustrated embodiment of the invention, it is advantageous if the contact surface is part of the support surface. This permits increased ease of manufacture.

In one illustrated embodiment, the leaf spring consists of a metallic material such as spring bronze. This permits compact dimensions of the leaf spring to be provided with a strong spring force and long term stability of that force. Furthermore, the leaf spring can carry at least a part of the current flowing through the contact. In special cases where such is not desired, the leaf spring may be made of an insulating material such as plastic.

Furthermore, as shown in the illustrated embodiment, the contact element can be shaped as a channel enclosing the leaf spring. In other words the side and top of the channel of the contact element will surround the leaf spring in a longitudinal direction along its sides and at its top. The contact element is formed to provide the abutment point for one end of the leaf spring and the support surface is formed by a tab cut in the top surface of the contact element for the other end and bent inward. The contact element whose primary purpose is to carry current thus surrounds the leaf spring in the manner of a box. The contact element thus forms the abutment and support surface of the leaf spring. This permits the contact element equipped with the leaf spring to form an effectively operating contacting device. The metallic material of the contact device insures, due to its hardness and strength, that the abutment has sufficient service life and that therefore, the distance between the abutment and the support surface will remain constant even over long term use. Due to the elastic force of the leaf spring, it rests in abutment under considerable pressure so that, if the leaf spring is of electrically conductive material, and thus serves to carry current, a low transition resistance to the contact element is assured. In addition to acting as a brace for the leaf spring, the contact element also acts to make contact with further contact means, such as connectors or contact blades of the subassembly modules.

As illustrated, it is particularly advantageous if the lateral surfaces of the contact element have tabs extending over the leaf spring ahead of the second end thereof. The support tabs are located above the plane of the leaf spring and supported above so that the second end of the leaf spring always springs back to the same respective initial position from the clamping position.

In one embodiment, the leaf spring and contact element are housed in a cavity of matching shape in a body of insulating material. The body has a connection opening for inserting the end of the wire, with the position of the wire, when inserted, situated above the release position of the second end of the leaf spring. In addition, the body or housing has two essentially opposite operating openings which extends in the longitudinal direction of the leaf spring and through which one surface of the leaf spring is always accessible. The insulating body acts to hold and brace the leaf spring and contact element, protects both against mechanical damage and, furthermore, insures high safety from user contact. The wire to be connected is inserted through the connecttion opening into the insulating body and comes to lie, assuming the leaf spring is in the release position, between the latter and the contact surface. Once a contact plug or screw driver is inserted into the opening opposite the connection opening, because of the ensuing action on the surface of the leaf spring, the latter is caused to snap into its second stable, clamping position. As a result the wire end is clamped between the contact surface and the second end of the leaf spring, the wire end being held by the elastic force of the leaf spring which becomes effective at the second end of the leaf spring in the tangential direction. Through the forces occurring at the edges of the leaf spring and the contact surface, as well as the wire end, poorly conducting surface layers are pierced and a reliable contact is made. In order to disconnect the contact made and permit the leaf spring to snap back into its release position, it is merely necessary to insert an elongated object, such as a screw driver, into the operating opening which is located on the same side as the connection opening. Thus, the contact arrangement of the present invention ensures easy handling while being perfectly safe in preventing any electrical contact with the user.

In accordance with a further feature of the present invention, contact lugs or straps of the contact element can project into the operating openings. The operating opening opposite the connection opening, therefore, not only serves for causing the leaf spring to snap into the clamping position, but also serves to make contact with additional contact pieces such as plug contacts or blade contacts of subassemblies. In this manner it is assured that, at the same time that the contact piece is inserted, the leaf spring snaps into the clamping position. Thus, even if one forgot to bring the leaf spring into the clamping position at the time that the conductor end is placed into the connection opening, this step ensures that clamping takes place. The contact lugs in the second operating opening located on the same side as the connection opening provide for a further connection point using wires or connector contacts that can be expediently connected to the contact device.

In accordance with another advantageous feature of the present invention, the top surface of the contact element projects into the connection opening and is arched in this region. The wire end is inserted into the connection opening and bears against the elastic force of the arched upper surface of the contact element to prove an additional mechanical hold to the wire end located in the connection opening.

In accordance with the illustrated embodiment the second end of the leaf spring has a forked shape. As a result, guidance of the second end of the leaf spring on the support surface is improved. The forked shape can be achieved by making a cutout in the second end of the leaf spring in the shape of a circular sector.

The support surface can also be made so as to have a substantially triangular shape with the free part of the second end of the leaf spring engaging over both its sides. In this manner clamping edges which are equivalent are far as their ability to fasten a wire end are obtained along the two free lateral edges of the tab shaped support surface between that surface and the free part of the second end of the leaf spring. In the illustrated embodiment, for use in connecting two wire ends, a separate connection opening is provided for each free part of the second end of the leaf spring. As a result two completely equivalent positions for fastening two separate wire ends utilizing a single contact device are obtained. By means of the free parts of the forked shaped second end of the leaf spring which protrudes in the longitudinal direction of the leaf spring, each of the two wires is pressed against a free side of the contact surface in the shape of a triangular tab. The leaf spring and the contact element can be connected to each other at the first end of the leaf spring in a highly conducting manner. This improves the reliability of the contact attainable with the device of the present invention since the leaf spring constitutes a parallel current path parallelling the path in the box shaped contact element.

As illustrated it is advantageous to make th body which consists of insulating material in two parts, with a separating plane between the two parts which is substantially perpendicular to the longitudinal dimension of the leaf spring. This permits, during production of the contact device, placing the leaf spring and the contact element into the cavity of the insulating body without effort.

The contact device of the present invention can be used to build up wiring panels or terminal boards. Such terminal boards are required, for example on the back side of subassembly chassis. This requires only an insulating material body which is provided with a plurality of cavities arranged in a predetermined grid arrangement, each adapted to receive a leaf spring and contact element as well as containing the associated operating and connecttion openings. It is particularly advantageous if the operating opening opposite the connection openings along with the contact lugs are arranged such that each can receive a contact blade or a blade strip. By doing so, such a wiring panel can be used in lieu of a wiring panel which consists of clamping pins, for instance, since the functional connection of modules in modular chassis, where the wiring can be carried out without special tools, and as compared to a conventional wiring panel, in a manner permitting changes can be made much more easily. In addition, a wiring panel constructed with the use of the contact device of the present invention requires a smaller overall depth than conventional wiring panels.

BRIEF DESCRIPTION OF DRAWINGS

FIG. 1*a* is a plan view of the leaf spring of the present invention.

FIG. 1*b* is an elevation view of the spring of FIG. 1.

FIG. 2 is a vertical cross section through a contact device according to the present invention disposed within a body of insulating material taken along line II — II of FIGS. 3 and 4.

FIG. 3 is a horizontal cross section along the line III — III of FIG. 2.

FIG. 4 is a horizontal cross section taken along the line IV — IV of FIG. 2.

FIG. 5 is a detailed cross section of expanded scale taken along the line V — V of FIG. 3 without the end of the wire shown.

FIG. 6 is a view of the contact device of the present invention within the body of the insulating material looking into connection openings, shown partially in cross section along the line VI — VI.

DETAILED DESCRIPTION OF THE PREFERRED EMBODIMENT

FIGS. 1*a* and 1*b* illustrate the leaf spring 1 of the present invention. as shown in these figures the leaf spring is symmetrical about a longitudinal axis 3. It is of elongated shape and has a first end 5 which is somewhat narrowed with respect to the rest of the spring, the spring being tapered. At the second end 7 a semicircular cutout results in a forked shape. By means of suitable choice of material for the leaf spring 1 and its dimensions, it can have the necessary mechanical properties, in particular, sufficient spring force. In general, the leaf spring will be made of a metallic material, in particular spring bronze, in order to optimize the reliability of contact and the quality due to the electric conductivity of this material. If required, it can also be of a plastic material.

The two basic elements of the contacting arrangement 9 of the present invention are the leaf spring 1 and a contact device 11. These devices are arranged within a body 15 of insulating material. This arrangement is illustrated on FIS. 2–6. The body 15 of insulating material will preferably be adapted for containing a plurality of contact elements 11 with associated leaf springs 7 in a predetermined grid arrangement. In the figures only one such device is illustrated. Thus, in order to accommodate the contact elements 11 and spring 1, a plurality of cavities 13 will be formed in a structure of insulating material 15. With reference to FIGS. 2, 3 and 4 the shape of the contacting device can be seen. The contact element 11 itself, is a generally channel shaped device. It includes a top 39 visible on FIG. 2 and sides 41 shown on FIGS. 3 and 4. At the left hand side of the insulating body 15 is a first opening 31. At the point of this opening, the sides 41 terminate in contact lugs 43. Similarly below the opening 31 on the right hand side of the figure is another opening 29 where the sides 41 terminate in a similar contact lug 45. Above the opening 29 are two additional openings 25. The top 39 of the contact element extends into these openings to form mechanical contacts 53. Furthermore, in the top 41 of the contact element, a cutout is made and bent down. This bent portion 21, hereinafter a support surface, terminates with a horizontal lip 37 on its end and rests against a corner 23 formed in the insulator body 15. It is of a generally triangular shape being tapered toward the end 37. The sides 41 at the bottom terminate in tabs 55 lying on opposite sides of a projection 19 in the insulator body 15. Near the bottom, a cutout is formed in these tabs 55. The cutout receives the one end 5 of the spring 1. The other end 7 of the spring rests against the support surface 21. The support surface 21 has edges or contact surfaces 21*a* which are the contact surfaces of the contact element 11. The corner 23 of the insulating body 15 provides sufficient mechanical support so that the leaf spring will always remain in the bent condition and cannot move the support surface 21. The point of abutment of the end 5 with the tabs 55 is designated as 17. The length between this point of abutment 17 and the support surface 21 is always smaller than the length of the leaf spring between its first end 5 and second end 7.

The leaf spring 1 is shown in its released position designated A. Its clamping position is shown in dotted lines designated by E on the figure. Intermediate positions between the release position and clamping position are designated B, C and D. The openings described above will now be explained. The openings 25 are adapted to receive wires which are to be clamped in place by the contact element 11 and spring 1 and are thus termed connection openings. As best shown on FIG. 3, a wire with a stripped end 27 is inserted into one of the openings 25 so that its stripped end passes into the area directly above the end 7 of the spring 1 and so that it lies adjacent the edge of the support member 21. The relative positions of the spring 1 and the support member 21 are shown in FIGS. 5 and 6. FIG. 6 shows them in the released position without the wire in place. As is shown in FIGS. 2, 3 and 6, the tabs 51 are bent out of the sides 41 of the contact element 11. As the wire 27 is inserted these tabs act to guide the end of the wire so that it is brought into abutment against the edge of the support element 21. This is illustrated best by FIG. 3. Once one or more wires are in place, the wires having been inserted through the openings 25, a contact or simply a screw driver can be inserted into the opening 31 to push down on the spring 1 to move it from its stable position A, the release position, to its second stable position E, the clamping position. As the spring moves from one position to another the end 7 moves up on the support surface 21 and acts to clamp the wire 27 between the fork on the end 7 and the support surface 21. The clamping position is illustrated by FIG. 5 where the wire would be disposed in the area designated 57. Preferably the edge of the end 7 of the leaf spring and the edge 21*a* of the support surface 21, best shown on FIG. 5, are made sharp so as to cut into the end of the wire to get below any insulating layers and make good contact. If the surfaces are made sharp enough, the possibility exits to insert wires which have not been stripped.

To release the conductors it is simply necessary to insert a screw driver or the like through the operating opening 29 to push against the leaf spring to cause it to go from the stable position E to the stable position A to release the conductors. This opening 29, because of the contact lugs 45, at the same time serves for making additional contact in the device.

Although a screw driver can be inserted into the operating opening 31 to carry out the clamping action, this opening is designed to accept a contact blade 35 and is designed such that the contact blade will carry out the clamping action. What this means is that even should the assembler forget to carry out clamping, before the insulating structure, which is noted above contains a plurality of contacting devices, is put to use, when the blade contacts of a mating connector are inserted into the openings 31, the clamping action will then take place. On the other hand, the distance from the contact at the opening 29 and the leaf spring when in the position E is great enough that placing a contact blade in the opening 29 will not result in the spring being moved from its clamping to its release position.

With respect to the intermediate position B, C, D and E, it is noted that once the spring reaches the position C under the influence of the contact blade 35, it is then unstable such that it will go to the clamping position rather than the release position. In other words, it flips over and as it flips over the forked end 7 slides up on the triangular side of the support 21 to carry out the clamping action. This clamping action results in both a good electrical and mechanical connection. The symmetrical design of the end 7 and the triangular support 21 permits wire ends to be connected and properly held electrically and mechanically on each of the two free sides of the support surface. The second wire would be inserted in the other opening 25 of FIG. 3. The knife edges of both the spring 7 and the support surface 21 make two points of knife like contact ensuring that any insulating layers are pierced. Once a connection is made current flows from the edges 21*a* of the support surface 21 of the contact element through the top surface 39 of the contact element, through the lateral surfaces 41 and from there through the contact lugs 43 into the contact blade 35, now in the position 35*a* shown in dotted lines.

As noted above, an additional wire can be inserted into the contact lugs 45 through the operating opening 29. However, the principal purpose of this opening is to permit the returning of the leaf spring from the clamping position E to the release position A. The insertion of a tool, e.g. screw driver, indicated in dotted lines as 47 in the direction of arrow 49 accomplishes this releasing. When going to the release position the tabs 51 ensure that the spring reaches its proper position. Thus, these tabs in addition to acting as guides for the wires 27 being inserted ensure that when the spring goes back to its release position the end 7 moves all the way down on the support surface 21 to permit ease of insertion of the wire ends 27. The extension 53 of the top 39 into the openings 25, these portions 53 being arched, act to clamp the insulated wires into the openings to provide additional support.

The ability to place a third conductor between the terminal lugs 45*a* gives complete equivalence between the contacting device of the present invention and those of the prior art. Another feature of the present invention is that the leaf spring because of its conducting connection at the support surface 21 and the paths 55 act as a parallel current path to improve conduction through the device.

On FIGS. 2–4, it is evident that the insulating body 15 is made in two parts. The two parts are separated at a plane E1. By making the body in two parts the insertion of the contact element 11 and the leaf spring 1 into the cavity 13 without effort is achieved.

As explained above in connection with FIG. 5 in particular, as the spring moves from its release position to its clamping position, the wire end 27 is moved along the edge 21*a* to carry out a scrapping action piercing the insulating surface layers. Ultimately, the wire end 27, which is lightly stress in shear is clamped fast. Because of the shape of the contact surface 21*a* and the fork shaped second end 7 of the leaf spring, it is possible that two wire ends 27 of different nature and diameter can be reliably connected. Furthermore, if more lateral displacement of the second end 7 of the leaf spring than is shown in FIG. 5 is provided, then wire ends having even larger diameter differences can be connected.

FIG. 6 in addition to showing the arrangement described above also shows the manner in which the insulating body 15 will contain more than one contacting device. Shown directly below the two openings 25 described above are additional openings 25 leading to an additional contact 11. The contact device of the present invention permits building up wiring panels which can be wired either partially or fully automatically. In such a case a contact blade for making the leaf spring 1 snap into the clamping position is run into the operating opening 31 from the opposite side using an automatic machine after one or two wire ends have been inserted in corresponding connection openings 25. After every wiring step the quality and correctness of the connection can at the same time be checked by means of the contact blade of the automatic wiring machine and a test report prepared. This provides ease in trouble shooting, particularly when building larger systems.

It should be noted that the contact device described can be used to advantage not only for building wiring panels in voltage ranges of up to 65 Volts as is common in electronic circuits, but, because of the high safety against operator contact, it can be used in the entire low voltage range up to about 1 kV. In summary, it can be stated that through the contact device according to the present invention, a novel connecting technique is made available which permits preparing a connection inexpensively regardless of the type and cross section of the wire ends to be connected and without the use of elaborate tools. Up to three connections can be made to one contact element. Furthermore, as compared to devices commonly in use previously, the contact device makes it easier to make changes.

What is claimed is:

1. In a contact device for connecting the end of an electrical wire in which an elastically deformable leaf spring mechanically fastens the wire end to a contact element with a contact surface and insures sufficient contact pressure between the end of the wire and the contact element, the leaf spring, having a first end disposed in the stationary manner against an abutment and a second end which is moveably supported at a support surface, the distance between the abutment and the support surface for said second end being smaller than the length of said leaf spring, said leaf spring convexally bent and pressed, when in a clamped position, with the end of the wire against the contact surface of said contact element, the improvement comprising, said support surface and second end of said spring cooperating such that, in one stable position of said leaf spring, said leaf spring second end will press a wire against the contact surface of the contact element and in another stable position will release said wire; and access openings in said contact device for permitting an outside mechanical influence to be applied to said leaf spring to move it between said one and other stable positions, the leaf spring being flexed in opposite directions in one and the other stable positions.

2. The improvement according to claim 1 wherein said contact surface is a part of said support surface.

3. The improvement according to claim 1 wherein said leaf spring is made of a metallic material.

4. The improvement according to claim 1 wherein said contact element has a channel shape including two sides and a top surface connecting the sides, said leaf spring being disposed laterally within said channel shaped contact element and wherein said abutment is formed at one end near the bottom of said channel shaped contact element and wherein said support surface comprises a tab bent inward from the top surface of said contact element.

5. The improvement according to claim 4 and further including support tabs formed in the sides of said contact element extending inward therefrom and disposed such that said spring rests thereagainst when in its first stable position in which it is released.

6. The improvement according to claim 5 and further including an insulating body having a cavity therein of a shape matching said contact element and wherein said contact element and spring are disposed within said insulating body in said cavity, said insulating body further including openings on opposite sides thereof acting as operating for inserting a tool to move said leaf spring from one stable position to the other and a connection opening for inserting a wire end such that it is disposed in a position above the second end of said leaf spring when said leaf spring is in the released position.

7. The improvement according to claim 6 and further including contact lugs on the sides of said contact element disposed at said operating openings.

8. The improvement according to claim 6 and further including an extension of the top of said contact element protruding into said connection opening said extension being arched in said region.

9. The improvement according to claim 8 wherein the second end of said leaf spring is forked.

10. The improvement according to claim 9 wherein said support surface is of an essentially triangular shape and wherein the free ends of said second end of said leaf spring extend over said support surface on both sides.

11. The improvement according to claim 10 and further including a second connection opening, said first and second connection openings disposed so that the wire ends inserted therethrough will lie on opposite sides of said triangularly shaped support surface for contact by the forked free part of said second end of said leaf spring.

12. The improvement according to claim 11 wherein said leaf spring and contact element make a conductive connection with each other at said first end.

13. The improvement according to claim 12 wherein said insulating body is of a two part construction with the plane separating the two parts substantially perpendicular to the longitudinal dimension of said leaf spring.

14. The improvement according to claim 13 wherein a plurality of cavities containg contact devices and leaf spring are disposed in a common insulating body whereby a terminal board may be built up.

15. The improvement according to claim 14 wherein the operating opening on the side opposite from the connection openings at each of said cavities is adapted for receiving a contact blade or a contact blade strip.

* * * * *